US010519700B2

(12) United States Patent
Mazal et al.

(10) Patent No.: US 10,519,700 B2
(45) Date of Patent: Dec. 31, 2019

(54) MOTOR VEHICLE DOOR LOCK

(71) Applicant: Kiekert Aktiengesellschaft, Heiligenhaus (DE)

(72) Inventors: Radek Mazal, Chleny (CZ); Jan Zejda, Chrudim (CZ)

(73) Assignee: Kiekert Aktiengesellschaft, Heiligenhaus (DE)

( * ) Notice: Subject to any disclaimer, the term of this patent is extended or adjusted under 35 U.S.C. 154(b) by 842 days.

(21) Appl. No.: 14/900,885

(22) PCT Filed: Jul. 3, 2014

(86) PCT No.: PCT/DE2014/000336
§ 371 (c)(1),
(2) Date: Dec. 22, 2015

(87) PCT Pub. No.: WO2015/000460
PCT Pub. Date: Jan. 8, 2015

(65) Prior Publication Data

US 2016/0153217 A1 Jun. 2, 2016

(30) Foreign Application Priority Data

Jul. 3, 2013 (DE) ..... 10 2013 107 000

(51) Int. Cl.
*E05B 79/10* (2014.01)
*E05B 85/24* (2014.01)

(52) U.S. Cl.
CPC ..... *E05B 85/243* (2013.01); *E05B 79/10* (2013.01)

(58) Field of Classification Search
USPC ..... 292/251.5, 201, 130, DIG. 21, DIG. 26
See application file for complete search history.

(56) References Cited

U.S. PATENT DOCUMENTS 2,243,179 A * 5/1941 Whittier ..... E05B 63/20 292/153
6,109,671 A 8/2000 Roncin et al.
(Continued)

FOREIGN PATENT DOCUMENTS

DE 10361168 A1 7/2005
DE 202007005076 U1 9/2007
(Continued)

OTHER PUBLICATIONS

Machine Translation of DE102008057478A1 by Lexis Nexis Total Patent on Dec. 15, 2015.
(Continued)

*Primary Examiner* — Kristina R Fulton
*Assistant Examiner* — Thomas L Neubauer
(74) *Attorney, Agent, or Firm* — Woodard, Emhardt, Henry, Reeves & Wagner, LLP

(57) ABSTRACT

The invention relates to a motor vehicle door lock which is equipped with a locking mechanism consisting substantially of a rotary latch and a pawl. A triggering element is additionally provided in order to lift the pawl and thereby open the locking mechanism. The motor vehicle door lock finally comprises an accumulator element which is impinged upon by a spring and which holds the pawl in the lifted position until the rotary latch is opened. According to the invention, the spring and the accumulator element form one component. Furthermore, the spring and the accumulator element are designed as a spring lip which impinges upon the trigger element.

19 Claims, 3 Drawing Sheets

(56) References Cited

U.S. PATENT DOCUMENTS

| | | | | |
|---|---|---|---|---|
| 9,617,760 | B2 * | 4/2017 | Dragon | E05B 77/38 |
| 9,945,164 | B2 * | 4/2018 | Perkins | E05B 81/28 |
| 2007/0007774 | A1 * | 1/2007 | Stefanic | E05B 81/14<br>292/216 |
| 2008/0202176 | A1 * | 8/2008 | Inan | E05B 77/38<br>70/237 |
| 2011/0031765 | A1 | 2/2011 | Vazquez | |
| 2015/0233156 | A1 | 8/2015 | Scholz et al. | |

FOREIGN PATENT DOCUMENTS

| | | | | |
|---|---|---|---|---|
| DE | 102008057478 | A1 | 5/2010 | |
| DE | 102010061427 | A1 | 6/2012 | |
| EP | 0978610 | A1 | 7/2005 | |
| EP | 1862618 | B1 | 7/2009 | |
| WO | WO 2014/036991 | A2 | 3/2014 | |
| WO | WO-2014036991 | A2 * | 3/2014 | E05B 85/26 |

OTHER PUBLICATIONS

Machine Translation of DE102010061427A1 by Lexis Nexis Total Patent on Dec. 15, 2015.
Machine Translation of DE10361168A1 by Lexis Nexis Total Patent on Dec. 15, 2015.
Machine Translation of DE202007005076U1 by Lexis Nexis Total Patent on Dec. 15, 2015.
Machine Translation of EP1862618B1 by Lexis Nexis Total Patent on Dec. 15, 2015.

* cited by examiner

MOTOR VEHICLE DOOR LOCK

BACKGROUND

The invention relates to a motor vehicle door lock, with a locking mechanism mainly consisting of a catch and a pawl, furthermore with a release lever to lift the pawl and thus open the locking mechanism and with an accumulator element actuated by a spring, which maintains the pawl in a raised position until the catch is completely or almost completely open.

A so-called buffer or buffer lever function in motor vehicles is typically executed on the rear motor vehicle door lock, i.e. the tailgate latch. With the aid of the buffer lever function, it is finally ensured that when the locking mechanism is open the pawl is not unintentionally engaged again or cannot intentionally be engaged with the catch. In practice, such situations are observed, for example, if the tailgate belonging to the tailgate latch is not completely opened or cannot be completely opened due to snow loads or other stresses.

In actual fact, in practice there is the risk of the locking mechanism not opening further than the pre-ratchet and the catch engaging again. The pertaining motor vehicle door latch thus needs to be reopened in order to be able to completely open the tailgate in the example case.

In order to manage such functional states, the generic state of the art in accordance with EP 1 862 618 B1 proposes that the buffer element is held at at least one latch component with the aid of the spring when the adjacent locking mechanism is opened. Thus, overall, the functional safety will be increased and a design with a simple construction will be provided.

In the further state of the art in accordance with US 2011/0031765 A1 a buffer element is provided for which is connected to a housing component. The buffer element has a stopper which interacts with a hook on the pawl in order to maintain this in an open position. If, during opening of the locking mechanism, the catch goes into its completely open position, a finger attached to the catch ensures that the buffer element is lifted from the pawl. Subsequently, the pawl glides along the catch and can no longer engage into the pre-ratchet.

The state of the art has fundamentally been proven, but can be improved. It is therefore evident in view of the EP 1 862 618 B1 that the buffer element and spring are separated from one another which increases technological expenditure and makes installation harder. Although US 2001/031765 A1 works here with a constructional unit from the buffer element and the spring so to speak, this acts on the pawl, however. Thus, a relatively discharging construction is followed. Because both the known buffer element and the locking mechanism consisting of a catch and a pawl are arranged at levels spaced apart.

If we now additionally still want to install the release lever, including the drive, a third level is typically required which increases the construction volume. However, nowadays motor vehicle door latches are required with compact dimensions and few functional components in order on the one hand to be able to use the limited available installation space inside a motor vehicle door and on the other hand to take into account the enormous price pressure. This is where the invention wishes to provide assistance.

SUMMARY

The invention is based on the technical problem of further developing such a motor vehicle door latch in such a way that compact external dimensions can be observed with, at the same time, a minimum of functional components and thus reduced costs.

In order to solve this technical issue, a generic motor vehicle door latch is characterized within the scope of the invention in that the springs and the buffer element form a constructional unit and are designed as the spring lip actuating the release lever. Usually the spring lip actuates the release lever in a transverse direction. i.e. the spring lip predominantly stretches transversely to the lengthwise direction of the release lever.

Generally, the spring lip and the release lever are primarily arranged on a common level. Furthermore, the catch and the pawl also span a locking mechanism level, which is typically arranged parallel to the level spanned by the spring lip and the release lever. Thus, a compact construction is initially provided. The circumstance that the pawl and the release lever generally lie on the same axle as one another contributes to this; consequently, the pawl and the release lever pivot around the same axis or rotational axis. Thus, the design can further occur so that the release lever and the spring lip actuating the release lever can be placed in control above the locking mechanism (or also under the locking mechanism). Thus, the spring lip can also be attached in overlap with the locking mechanism in a housing.

According to an advantageous design, the springs and the buffer element not only form a constructional unit, but are also regularly designed as a single component and together define the spring lip. Furthermore, it has been proven when the spring lip in question is connected to the relevant housing and/or a latch component.

The housing or latch component is generally a plastic component. In this case it has been proven when the spring lip is molded to the housing and/or the latch component. In actual fact, the spring lip and the housing and/or the latch component overall can be designed as a single component plastic molding. i.e. the housing or the latch component and the spring lip are regularly manufactured at the same time, for example by a plastic injection molding process. Thus, the costs of the spring lip can be especially low.

The housing is generally the so-called latch housing. The latch housing regularly functions as a lid, with the help of which a latch case accommodating the locking mechanism is covered and closed. The latch component can be a dividing wall separate from the housing inside the housing or latch housing. Naturally, other latch components (typically made of plastic) are also suitable. As a rule, however, the latch component is designed as a so-called electrical component carrier.

Such an electrical component carrier is a plastic plate or also a plastic circuit board, the purpose of which is to hold electrical components to be arranged inside the pertaining motor vehicle door latch, such as one or several motors, switches, electronic components, etc. An example of an electrical component carrier for motor vehicle door locks is described in DE 20 2007 005 076 U1 of the applicant, to which explicit reference is made. Furthermore, DE 10 2008 057 478 A1 of the applicant is stated.

It has been proven if the spring lip is mainly aligned tangentially compared to an arc-shaped pivoting movement described by the release lever. Actually, the release lever is advantageously a triggering lever which pivots compared to its rotational axis. This rotational axis generally functions simultaneously as a rotational axis for the pawl. However, an activation of the release lever or triggering lever corresponds to the release lever or the triggering lever performing a pivoting movement around the stated rotational axis. In this process, the release lever carries the pawl along, insofar as an opening movement of the locking mechanism should be initiated as a result.

In order that the release lever and also the pawl (simultaneously) are held in an open position or raised position, the spring lip typically interacts with a molding on the release lever. As the spring lip is mainly arranged tangentially to the described arch-shaped pivoting movement of the release lever around its rotational axis, it is sufficient in this process if the spring lip reaches behind or also under the molding on the release lever in question. This functional position is maintained until the catch goes into its completely or almost completely open position.

According to an advantageous design, the catch has a contour interacting with the spring lip. The contour generally ensures that the catch lifts up the spring lip from its rest on the release lever during its opening movement. i.e. as soon as the contour on the catch works on the spring lip, the spring lip is lifted from its rest on the molding on the release lever. Consequently, subsequently the release lever and also the pawl can no (longer) be held in the raised position. A spring may take care of this which actuates the release lever and also the pawl relevantly. Subsequently, the pawl lies flat on an external edge of the catch, but can no (longer) become engaged in a pre-ratchet recess, because the catch is open until beyond this pre-ratchet recess.

As the spring lip according to advantageous design is molded to the housing and/or the latch component (made of plastic), it is recommended that the spring lip performs a principally vertical deflecting movement compared to its lengthwise extension. i.e. the spring lip is pivoted vertically to its lengthwise extension in order to be able to interact with the molding on the release lever as soon as the release lever experiences an actuation in the sense that the pawl is lifted off the catch. Vice versa, the spring lip is also deflected vertically to the lengthwise extension if the catch with its contour lifts off the spring lip from its rest on the release lever during opening.

Such vertical deflecting movements of the spring lip compared to the lengthwise extension can be achieved easily and durably with plastic materials due to the inherent elasticity. I.e. at this point some damage in the area of the connection between the spring lip on the housing or the latch component (electrical component carrier) must not be feared. Instead, a durable and functional operation must be assumed whereby special cost advantages are simultaneously observed due to the simple design of the spring lip.

In actual fact, in this context it is sufficient if the spring lip is designed as a lengthwise support molded to the housing or the latch component. The lengthwise support can be equipped with a cross bar on the front in order to increase the common contact surface between the recess on the triggering lever and the spring lip.

As a result, a motor vehicle door lock is provided which initially manages with a minimum of functional components. In actual fact, the springs and buffer element are condensed into a spring lip which advantageously involves a single-component molding on the housing or latch component of the motor vehicle door lock. There is also the fact that in accordance with the invention the spring lip keeps the release lever and consequently directly the pawl in a raised position until the catch is open. Thus, the spring lip and the release lever can be arranged in a common level and namely furthermore in control over (or under) the locking mechanism level in question. Thus, the pertaining motor vehicle door latch has an especially compact and narrow design. These are the crucial advantages.

Hereinafter, the invention is explained in further detail on the basis of a sketch which only depicts an execution example. It shows:

DETAILED DESCRIPTION OF THE DRAWINGS

Figure 2:
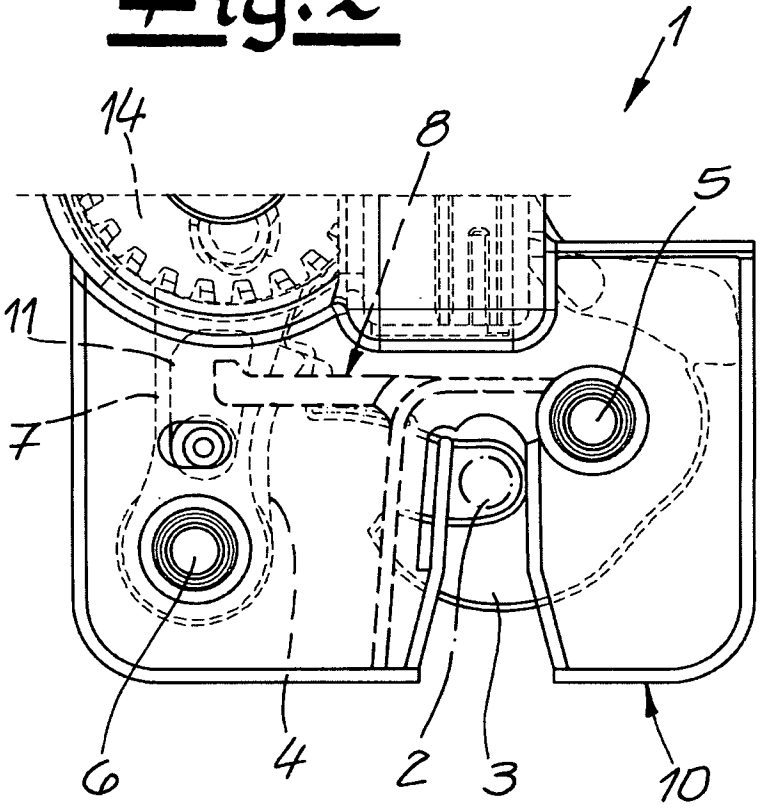

In the figures, a motor vehicle door latch is represented which basically comprises the respectively shown motor vehicle door latch 1 in the interior of a motor vehicle door and a solely indicated locking bolt 2 on a motor vehicle chassis. The motor vehicle door latch 1 respectively has a locking mechanism 3, 4 consisting of a catch 3 and a pawl 4. The locking mechanism 3, 4 is located in a not explicitly shown latch case and spans a pertaining locking mechanism level.

The catch 3 is stored on a bolt 5 anchored in the latch case which simultaneously functions as a rotational axis 5 for the catch 3. A further bolt 6 anchored in the latch case is available to accommodate the pawl 4 which defines the rotational axis 6 for the pawl 4.

A release lever 7 lies on the same axle as the pawl 4. i.e. the pawl 4 and the release lever 7 lie on the same axle with reference to the common rotational axis 6 in the latch case. The release lever 7 is a triggering lever 7 which performs or can perform arc-shaped pivoting movements or arch-shaped and in particular circular arch-shaped pivoting movements around the rotational axis 6 in question. This is indicated by relevant arrows.—A pivoting movement of the release lever 7 can be initiated mechanically in the sense of 'opening electrically' or manually by actuation of an internal door handle/external door handle.

Furthermore, a buffer element 8 is recognized which forms a constructional unit within the scope of the invention together with a spring. In actual fact, the buffer element 8 is designed as a plastic lengthwise support 8*a* in the present case and in the position in the deflecting movements indicated in FIGS. 3B to 3C and 4B to 4C by (black) arrows predominantly vertically compared to its lengthwise extension.

The springs and the buffer element 8 form a constructional unit and are designed as the spring lip 8 actuating the release lever 7 in accordance with the invention. It is recognized that the spring lip 8 and the release lever 7 are crucially arranged in a common level or describe such a common level. The level spanned by the release lever 7 in conjunction with the spring lip 8 is crucially arranged in parallel to the locking mechanism level. In accordance with the execution example, the level spanned by the release lever 7 and the buffer element 8 is above the locking mechanism level. Furthermore, it is designed in such a way that at least the spring lip 8 covers the locking mechanism 3, 4. This partly also applies to the release lever 7, which—as already explained—lies on the same axle as the pawl 4 on the common axis 6.

Furthermore, the spring lip 8 predominantly stretches transversely to the lengthwise extension of the release lever 7.

Figure 1:
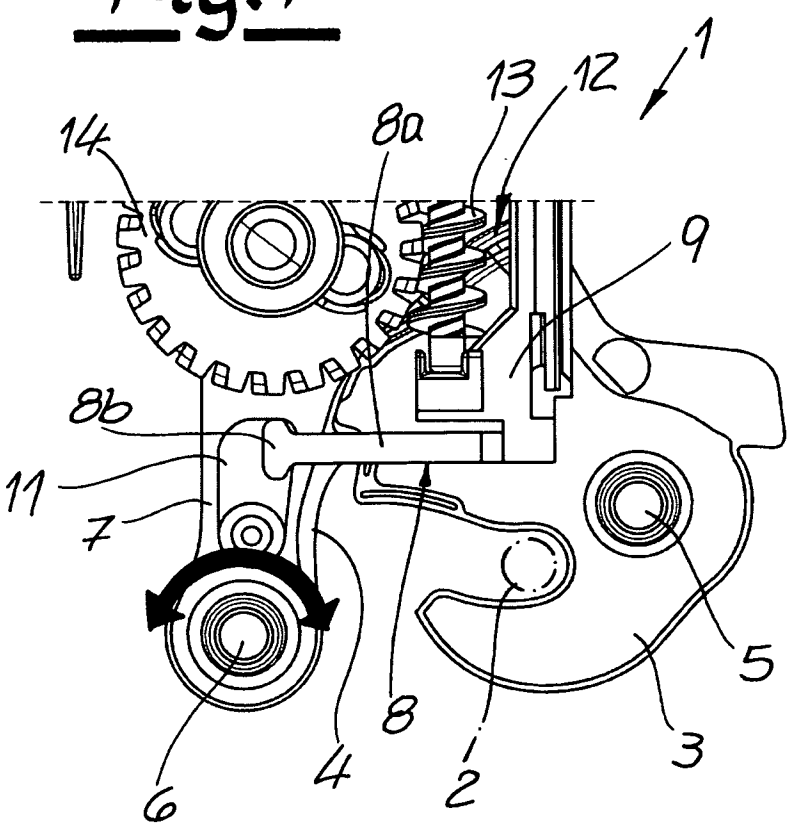
FIG. 1 a first variant of the motor vehicle door lock in accordance with the invention in an overview without housing, FIG. 2 the object in accordance with FIG. 1 in a further second variant with housing FIG. 3A-3D the motor vehicle door latch in accordance with FIG. 1, reduced to the different functional settings for the crucial components and FIG. 4A-4D the motor vehicle door latch in accordance with FIG. 2 in the different functional settings.

The springs and the buffer element 8 are designed as single components and connected to a latch component 9 in the execution example in accordance with FIG. 1. In the variant in accordance with FIG. 2 the spring lip 8 or the construction unit consisting of the spring and the buffer element 8 are connected to a housing 10 on the other hand. The latch component 9 and the housing 10 are respectively plastic components. Furthermore, the design is such that the spring lip 8 in question is molded to the relevant plastic component. The procedure is usually such that the latch component 9 and the spring lip 8 or the housing 10 and the spring lip 8 are respectively manufactured in a common plastic injection molding process. i.e. the spring lip 8 and the housing 10 and/or the latch component 9 are respectively designed as a single-piece plastic component.

With a comparative observation of the two execution variants in accordance with FIGS. 1 and 2 it is clear that the spring lip 8 is mainly tangentially aligned compared to the circular arched pivoting movements described by the release lever 7 and already referred to. Thus, the spring lip 8 can easily interact with a molding 11 on the release lever 7. This molding 11 on the release lever 7 within the scope of the two execution variants in accordance with FIGS. 1 and 2 is a level range 11 on the surface of the release lever 7. This is also recognized in FIGS. 3A to 3D and 4A to 4D.

It is known that the first variant in accordance with FIG. 1 corresponds to the illustrations in FIG. 3A to 3D, where the variant in accordance with FIG. 2 concurs with the sketches in FIG. 4A to 4D. The spring lip 8 is predominantly designed as a lengthwise support 8*a*. In addition, on the end side of the lengthwise support 8*a* in question at least one transverse support 8*b* is provided for. That applies to both execution variants. With the aid of the transverse support 8*b* the active surface can be increased in the interaction of the spring lip 8 with the molding or the step range 11.

The catch 3 has a contour 12 on its upper side which interacts or can interact with the spring lip 8. In actual fact, the contour 12 on the catch 3 ensures in the course of the opening movement of the catch 3 that the spring lip 8 is lifted from its rest on the release lever 7. To this end, a contour 12 is provided for in the area of a main ratchet of the catch 3.

Both the engagement process of the spring lip 8 so to speak behind the molding or the step range 11 on lifting of the trigger element 7 together with the pawl 4 from the catch 3 and also the lifting process of the spring lip 8 from the molding in question 11 during complete opening of the catch 3 respectively correspond to the spring lip 8 performing the already described and crucially vertical deflection movements compared to its lengthwise expansion. This is indicated by corresponding arrows in FIGS. 3A to 3D and 4A to 40. Such deflection movements of the spring lip 8 are easily possible due to their plastic design, because corresponding materials have the necessary elasticity, the lengthwise support 8*a* therefore functions as a spring.

As already explained in the introduction, the latch component 9 can be designed as an electrical component carrier 9. Such an electrical component carrier is regularly separated from the housing 10 placed in its interior and its purpose, for example, is to hold and contact an electrical motor or also other electrical/electronic components. Within the scope of the variant in accordance with FIG. 1, it is recognized that the electrical component carrier 9 there partly functions as a storage site for an output shaft 13 of an electrical motor. With the aid of the drive shaft 13 a worm gear 14 is set to rotate and in the present case ensures that the release lever or the triggering lever 7 actuate in the sense of 'electrically open'.

Figure 3:
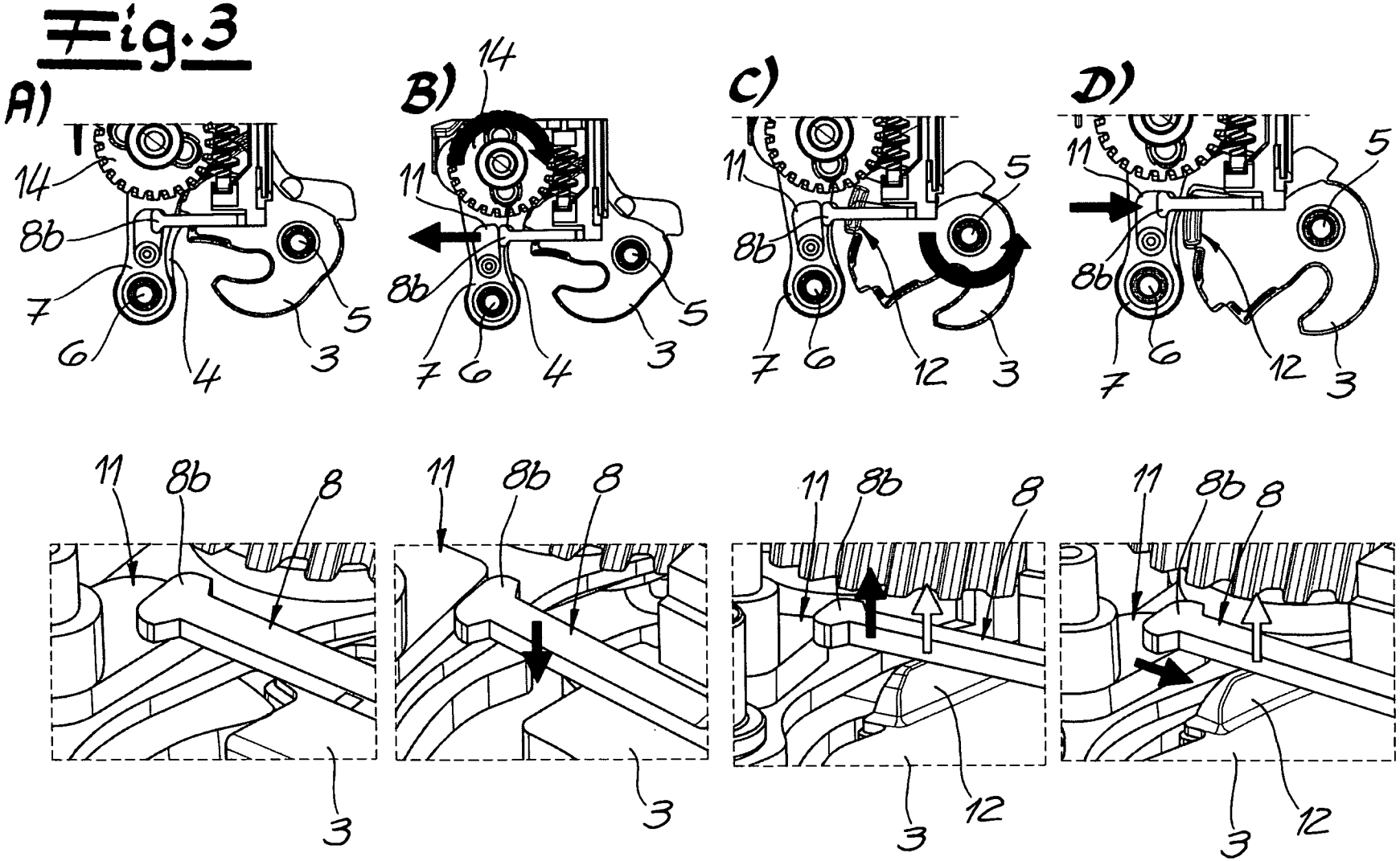
Figure 4:
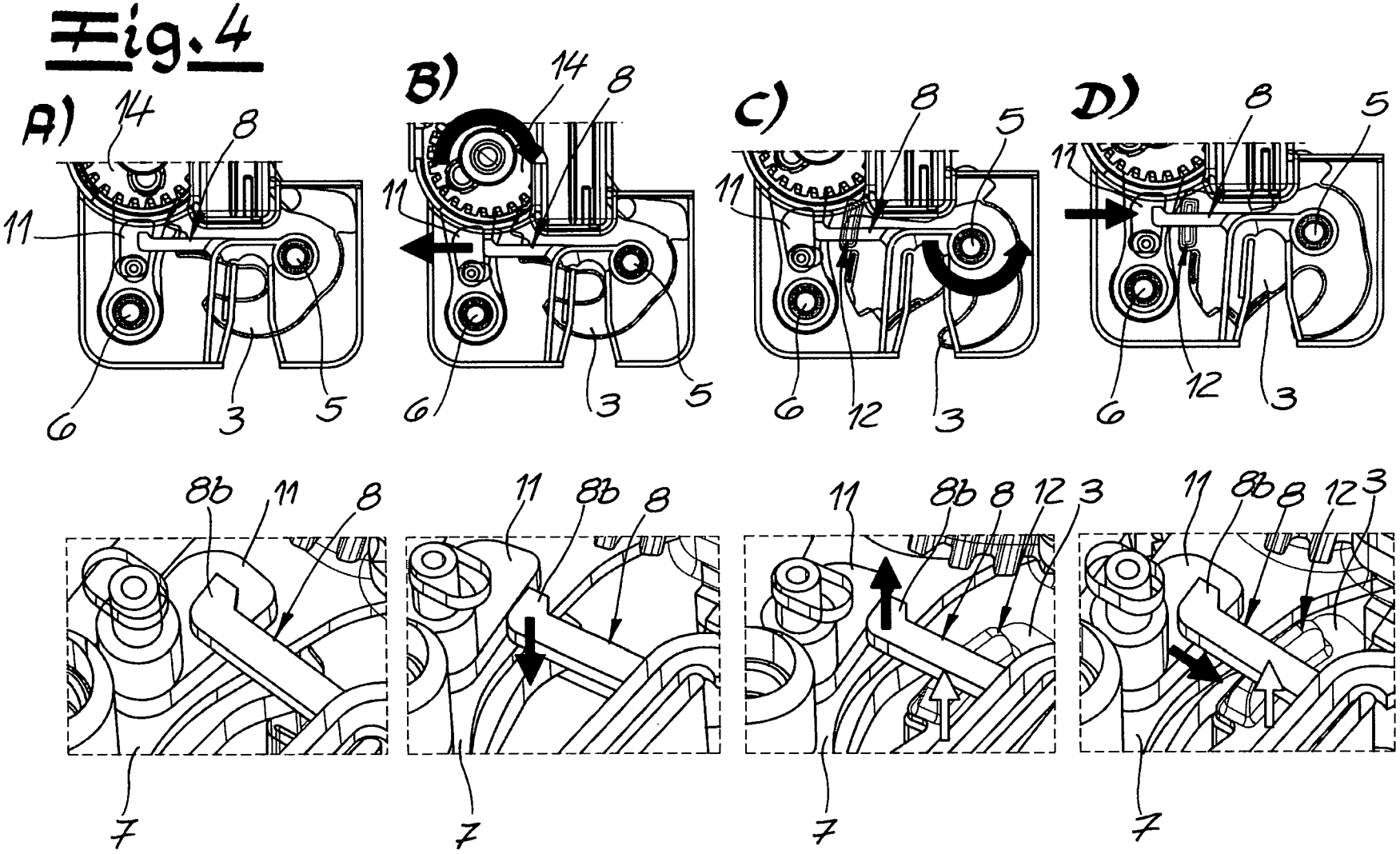

A corresponding pivoting movement of the triggering lever 7 around the pertaining rotational axis 6 anticlockwise during the transition from FIG. 3A to FIG. 3B simultaneously corresponds to the pawl 4 being carried along and releasing the catch 3. In order to initiate the described movement of the release lever 7, the worm gear 14 is moved in a clockwise direction during transition from FIG. 3A to FIG. 3B in roughly a four-component revolution. However, the release lever 7 carries the pawl 4 along via a corresponding and invisible contour in the triggering movement and lifts this from the catch 3 during transition from FIG. 3A to FIG. 3B.

As a consequence hereof, the spring lip 8 with its transverse support 8*b* can engage behind the molding 11 or the step range 11 on the release lever 7 as depicted. In this functional position the pawl 4 is lifted from the catch 3. The catch 3 can now open with the help of a spring, by performing a relevant pivoting movement in an anticlockwise direction around its axis 5, as becomes clear during the transition from FIG. 3B to FIG. 3C. A further opening movement of the catch 3 now leads to the contour 12 provided for in the area of a main ratchet reaching the catch 3 in the area of the spring lip 8 and being able to interact with the spring lip 8.

In actual fact, the contour 12 arising so to speak on the catch 3 in this process ensures that the catch 3 lifts the spring lip 8 from its rest on the release lever 7 in the course of its opening movement. The contour 12 pushes the spring lip 8 up. Consequently, the transverse support 8*b* of the spring lip 8 is removed from the molding or the step range 11.

Now a force affecting the release lever 7 and indicated by a (white) arrow in FIGS. 3C and 3D and 4C and 40 of a non-illustrated spring can ensure that the release lever 7 and also the pawl 4 are pivoted in the direction of the opening catch 3, namely in a clockwise direction around the common axis 6. As the contour 12 on the catch 3 is arranged in the area of its main ratchet, 30 the main ratchet of the catch 3 passes the pawl 4 so to speak during the opening movement. Therefore the pawl 4 can neither engage in the pre-ratchet nor the main ratchet of the catch 3, consequently the locking mechanism 3, 4 opens as requested and releases the previously caught bolts 2.

A comparable functional procedure is observed in FIG. 4A to 4D. Also in this case the spring lip 8 initially catches with its transverse support 8*b* during transition from FIG. 4A to FIG. 48 behind the molding 11 on the triggering lever 7. The opening movement for the triggering lever 7 is again initiated by the worm gear 14 which is actuated by the electrical motor depicted in FIG. 2.

In FIGS. 4B and 4C the release lever 7 and also the pawl 4 of the catch 3 is held in the elevated position. The catch 3 can consequently open with the aid of a spring by performing the indicated pivoting movement around its axis 5 in an anti-clockwise direction. As soon as, within the scope of the illustration in accordance with FIG. 4D, the contour 12 lifts the spring lip 8 from the molding 11 on the release lever 7, the release lever 7 can pivot actuated by the springs in the direction of the catch 3. Hereby the release lever 7 and the pawl 4 jointly perform a pivoting movement around the pertaining axis or rotational axis 6, and namely in a clockwise direction, until the pawl 4 is adjacent to the catch 3, and namely beyond its main ratchet. Thus, the pawl 4 can no longer engage in the catch 3 and the catch 3 goes into its completely open position. The locking bolt 2 is released.

The invention claimed is:

1. A motor vehicle door lock with a locking mechanism comprising:

a catch movable between a locked position and an unlocked position, wherein the catch comprises a contour, a pawl movable between a blocking position where the pawl blocks the catch from moving to the unlocked position and a free position where the pawl does not block the catch from moving, a release lever movable between a first position where the release lever does not move the pawl and an unlocking position where the release lever moves the pawl to the free position to lift the pawl off the catch and open the locking mechanism, a buffer element movable between a holding position where the buffer element holds the release lever in the unlocking position and a disengaged position where the buffer element does not block the release lever from moving, wherein the buffer element is biased toward the holding position and wherein when the catch moves to the unlocked position, the contour moves the buffer element from the holding position to the disengaged position, wherein, in the free position, at least a portion of the buffer element rests on the release lever which prevents the buffer element from returning to the holding position.

2. The motor vehicle door lock according to claim 1, wherein the buffer element comprises a lengthwise support, wherein a first end of the lengthwise support is fixed relative to the pawl and wherein a second end of the lengthwise support is movable, wherein the lengthwise support resists deflection which biases the buffer element toward the holding position.

3. The motor vehicle door lock according to claim 1, wherein the buffer element extends transversely to a lengthwise extension of the release lever.

4. The motor vehicle door lock according to claim 1, wherein the release lever further comprises a molding and wherein the buffer element abuts the molding.

5. The motor vehicle door lock according to claim 2, wherein the lengthwise support of the buffer element extends transversely to a lengthwise extension of the release lever.

6. The motor vehicle door lock according to claim 2, wherein the first end of the lengthwise support is connected to a housing or a latch component.

7. The motor vehicle door lock according to claim 6, wherein the buffer element is molded as part of the housing or the latch component.

8. The motor vehicle door lock according to claim 7, wherein the buffer element and either the housing or the latch component are a single unitarily formed plastic component.

9. A motor vehicle door lock with a locking mechanism comprising:

a catch movable between a locked position and an unlocked position, wherein the catch comprises a contour, a pawl movable between a blocking position where the pawl blocks the catch from moving to the unlocked position and a free position where the pawl does not block the catch from moving, a release lever movable between a first position where the release lever does not move the pawl and an unlocking position where the release lever moves the pawl to the free position to lift the pawl off the catch and open the locking mechanism, a buffer element movable between a holding position where the buffer element holds the release lever in the unlocking position and a disengaged position where the buffer element does not block the release lever from moving, wherein the buffer element is biased toward the holding position and wherein when the catch moves to the unlocked position, the contour moves the buffer element from the holding position to the disengaged position, wherein the pawl and the release lever rotate about a common rotational axis.

10. The motor vehicle door lock according to claim 9, wherein the catch and pawl rotate on a first plane and the release lever rotates on a second plane that is spaced apart from the first plane.

11. The motor vehicle door lock according to claim 10, wherein, in the holding position, the buffer element is positioned on the second plane.

12. The motor vehicle door lock according to claim 11, wherein the contour on the catch extends into the second plane.

13. The motor vehicle door lock according to claim 11, wherein, in the free position, at least a portion of the buffer element is not in either the first or second plane.

14. The motor vehicle door lock according to claim 12, wherein, while the catch moves from the locked position to the unlocked position, the contour contacts the buffer element and moves at least a portion of the buffer element out of the second plane.

15. The motor vehicle door lock according to claim 14, wherein the buffer element comprises a lengthwise support, wherein a first end of the lengthwise support is fixed relative to the pawl and wherein a second end of the lengthwise support is movable, wherein the lengthwise support resists deflection which biases the buffer element toward the holding position.

16. The motor vehicle door lock according to claim 15, wherein, in the free position, at least a portion of the buffer element rests on the release lever which prevents the buffer element from returning to the holding position.

17. A motor vehicle door lock with a locking mechanism comprising:

a catch movable between a locked position and an unlocked position, wherein the catch comprises a contour, a pawl movable between a blocking position where the pawl blocks the catch from moving to the unlocked position and a free position where the pawl does not block the catch from moving, a release lever movable between a first position where the release lever does not move the pawl and an unlocking position where the release lever moves the pawl to the free position to lift the pawl off the catch and open the locking mechanism, a buffer element movable between a holding position where the buffer element holds the release lever in the unlocking position and a disengaged position where the buffer element does not block the release lever from moving, wherein the buffer element is biased toward the holding position and wherein when the catch moves to the unlocked position, the contour moves the buffer element from the holding position to the disengaged position, wherein the catch and pawl rotate on a first plane and the release lever rotates on a second plane that is spaced apart from the first plane.

18. The motor vehicle door lock according to claim 17, wherein, in the holding position, the buffer element is positioned on the second plane.

19. The motor vehicle door lock according to claim 18, wherein the contour on the catch extends into the second plane and wherein, while the catch moves from the locked position to the unlocked position, the contour contacts the buffer element and moves at least a portion of the buffer element out of the second plane.

* * * * *